United States Patent [19]

Taylor

[11] 4,254,355

[45] Mar. 3, 1981

[54] CERAMIC ARC TUBE MOUNTING

[75] Inventor: William L. Taylor, East Cleveland, Ohio

[73] Assignee: General Electric Company, Schenectady, N.Y.

[21] Appl. No.: 941,566

[22] Filed: Sep. 11, 1978

[51] Int. Cl.[3] ..... H01J 5/48; H01J 61/30

[52] U.S. Cl. ..... 313/25; 313/184

[58] Field of Search ..... 313/184, 25

[56] References Cited

U.S. PATENT DOCUMENTS

| | | | |
|---|---|---|---|
| 2,240,333 | 4/1941 | Hodge | 313/184 X |
| 3,882,346 | 5/1973 | McVey | 313/184 X |
| 4,065,691 | 12/1977 | McVey | 313/220 X |

FOREIGN PATENT DOCUMENTS 49-27264 8/1974 Japan .

*Primary Examiner*—Palmer C. Demeo

*Attorney, Agent, or Firm*—Ernest W. Legree; Lawrence R. Kempton

[57] ABSTRACT

An improved mounting of the ceramic arc tube on a support rod attached to one lead-in within an outer vitreous envelope allows for thermal expansion. The inlead at one end of the arc tube is fastened to the support rod which serves also as conductor, while that at the other end extends through an insulating bushing supported from the rod and is connected by a curved flexible conductor to the other lead-in of the outer envelope. Differential thermal expansion is accommodated by sliding of the inlead through the bushing and flexing of the curved conductor.

7 Claims, 2 Drawing Figures

Fig. 1
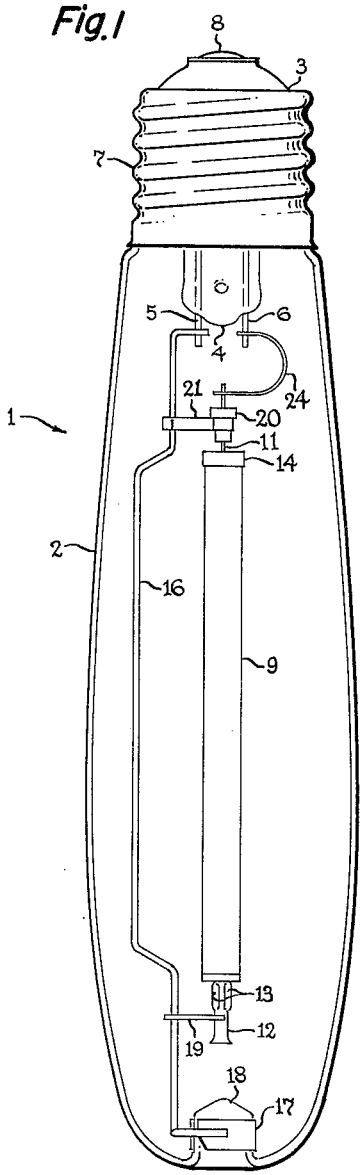
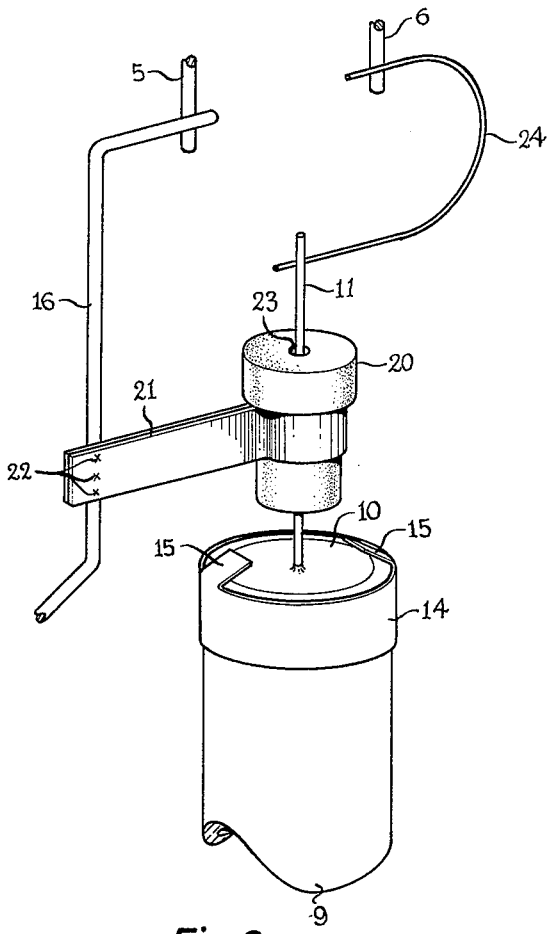
Fig. 2

CERAMIC ARC TUBE MOUNTING

The invention relates to a high intensity discharge lamp comprising a ceramic arc tube mounted within an outer glass envelope or jacket, and applies particularly to high pressure sodium vapor lamps.

BACKGROUND OF THE INVENTION

The arc tube of crystalline alumina ceramic in a high pressure sodium vapor lamp may be heated in operation to an average temperature of 1000° C. or higher, and the material has a coefficient of linear expansion of $8\times10^{-6}$ per °C. The arc tube is so hot that the only practical way of supporting it is by the inleads extending from the ends. In a typical 400 watt lamp, the arc tube is about 11 centimeters long and will expand about 1 millimeter. The metal support frame and the vitreous outer envelope will not expand nearly as much, and moreover the expansion of the various parts does not occur at the same time when the lamp is warming or cooling. Accordingly it is necessary to accommodate differential expansion in order to avoid undue stress on the inleads and seals which may lead to fatigue and premature lamp failure through cracking of the seals or rupture of the welds to the inleads. This need is particularly great with ceramic plug type seals such as used in the lamp described in U.S. Pat. No. 4,065,691 - McVey, Ceramic Lamp Having Electrodes Supported By Crimped Tubular Inlead.

In McVey U.S. Pat. No. 3,882,346 - Ceramic Arc Tube Mounting Structure, a differential expansion compensating mounting is described and claimed which has found substantial use with lamps utilizing ceramic plug seals. While that structure is quite satisfactory in service, a mounting which is cheaper and more easily manufactured is desired, and the object of the invention is to provide such a mounting.

SUMMARY OF THE INVENTION

An improved mounting embodying the invention comprises a sturdy support rod extending substantially the length of the outer envelope, being fastened to a heavy lead-in at the stem end and braced to the envelope at the distal end. This rod serves both as support and as conductor, and the tubular inlead at the lower end of the arc tube is connected to it. The inlead at the upper end is a wire and it extends along the axis of the arc tube through an insulating bushing supported from the rod; a curved flexible conductor connects the wire inlead to the other heavy lead-in of the outer envelope. Differential thermal expansion is accommodated by sliding of the wire inlead through the bushing and flexing of the flexible conductor.

DESCRIPTION OF THE DRAWING

In the drawing:

FIG. 1 shows a high pressure sodium vapor lamp having a mounting of the arc tube which embodies the invention.

FIG. 2 is an enlarged pictorial detail showing the insulating bushing and the inlead slideable through it.

DETAILED DESCRIPTION

A high pressure sodium vapor lamp 1 embodying the invention and corresponding to a 400 watt size is illustrated in FIG. 1. It comprises a vitreous outer envelope 2 with a standard mogul screw base 3 attached to the stem end which is shown uppermost. A re-entrant stem press 4 has a pair of relatively heavy lead-in conductors 5,6 extending through it whose outer ends are connected to the screw shell 7 and eyelet 8 of the base.

The inner envelope or arc tube 9 centrally located within the outer envelope comprises a length of light-transmitting ceramic tubing, suitably polycrystalline alumina ceramic which is translucent, or single crystal alumina which is clear and transparent. The upper end of the arc tube is closed by an alumina ceramic plug 10 through which extends hermetically a niobium inlead wire 11 which supports the upper electrode (not shown). The lower end closure also comprises a ceramic plug through which extends a thin-walled niobium tube 12 which serves both as inlead and as a reservoir for excess alkali metal mercury. The shank of the lower electrode projects into tube 12 and is locked in place by crimping the tube about it at 13. The crimping leaves restricted channels which allow passage of the alkali and mercury in vapor form but prevent its movement as a liquid amalgam whereby the lamp may be burned in any orientation base up or base down. A metal reflector such as band 14 shown around the upper end of the arc tube may be desirable in order to maintain the desired temperature at either end seal, particularly in smaller sizes of lamps; the tabs 15 on the band help to hold it in place. For further details on the construction of the arc tube and the ceramic seals, reference may be made to U.S. Pat. No. 4,065,691 - McVey, Ceramic Lamp Having Electrodes Supported By Crimped Tubular Inlead.

My invention resides in the specific mounting arrangement of the arc tube within the outer envelope which allows for differential thermal expansion with a minimum number of easily assembled parts. A sturdy support rod 16 extends substantially the length of the outer envelope and is welded to lead-in conductor 5 at the stem end, while it is braced by spring clamp 17 which engages inverted nipple 18 in the distal or dome end of the outer envelope. The arc tube is supported primarily by connector 19 which is welded across from tubular inlead 12 to support rod 16. Conductor 19 is stiff (unannealed) wire and tubular inlead 12 may be considered fixed relative to support rod 16. At the upper end, axial inlead wire 11 extends through an insulating bushing 20 which is supported from rod 16 by means of metal strap 21 wrapped tightly around it and spot-welded at 22 to the support rod. The aperture 23 through the bushing is sized to permit free axial movement of inlead wire 11 without allowing excessive side play. A resilient flexible conductor 24 curved to form a 180° open loop has one end welded to inlead wire 11 above the bushing and the other end welded to lead-in conductor 6. Differential thermal expansion is accommodated by axial movement of inlead 11 through bushing 20 and by flexing of loop conductor 24 which exerts no appreciable mechanical restraint on inlead 11. In the drawing, flexible conductor 24 is shown as a relatively fine wire; a thicker wire which has been annealed to make it more flexible may be used; a thin metal foil has also been used and is equally suitable.

While the invention has been illustrated and described and is particularly useful in connection with ceramic plug end seals, it may also be used with end seals using the niobium end caps of the prior art. In such construction the axial fine wire inlead 11 may be simply welded to the upper metal end cap and the mounting arrangement is otherwise unchanged.

The mounting according to the invention provides full restraint at the lower end of the arc tube and axial freedom coupled with lateral restraint at the upper end. The flexible conductor 24 serves as an electrical connection only and is not intended to provide restraint. By reason of its flexibility relative to the other conductor and its 180° open loop, it can flex without creating any strain on either the inleads or the weld connections. The invention thus accomplishes its purpose with a minimum number of parts and a simple readily assembled structure.

What I claim as new and desire to secure by Letters Patent of the U.S. is:

1. A high intensity discharge lamp comprising:

an outer vitreous envelope having a pair of lead-in conductors sealed into it at the stem end, an inner tubular ceramic envelope having closures sealing its ends and containing an ionizable medium, and inleads extending from said closures and making connections to electrodes within said inner envelope, one of said inleads being a wire extending substantially on axis, a metal support rod extending within said outer envelope, said rod being attached to one of the lead-in conductors at the stem end, a connector providing a rigid connection between the other inlead and said support rod, and an insulating bushing supported from said support rod and having a hole therethrough through which said axial wire inlead slideably extends, said bushing allowing axial freedom but providing lateral restraint to said wire inlead, and a flexible conductor extending from said wire inlead to said other lead-in conductor, said flexible conductor providing an electrical connection without appreciable mechanical restraint on said wire inlead.

2. A lamp as in claim 1 wherein said closures are ceramic plugs and one inlead is a wire sealed through one plug while the other inlead is a metal tube sealed through the other plug.

3. A lamp as in claim 1 wherein said flexible conductor extending from said wire inlead to the other lead-in conductor is formed into an open loop.

4. A lamp as in claim 1 wherein said flexible conductor extending from said wire inlead to the other lead-in conductor is a thin metal foil.

5. A lamp as in claim 1 wherein said support rot extends substantially the entire length of said outer envelope and is braced to the outer envelope at the distal end.

6. A lamp as in claim 1 including a base attached to the stem end and having terminals to which said lead-in conductors are connected.

7. A lamp as in claim 2 wherein said support rod extends substantially the entire length of said outer envelope and is braced to the outer envelope at the distal end and including a base attached to the stem and having terminals to which said lead-in conductors are connected.

* * * * *